US006419452B1

(12) United States Patent
Frosini et al.

(10) Patent No.: US 6,419,452 B1
(45) Date of Patent: Jul. 16, 2002

(54) SECURING DEVICES FOR BLADES FOR GAS TURBINES

(75) Inventors: Franco Frosini; Luciano Mei, both of Sesto Fiorentino (IT)

(73) Assignee: Nuovo Pignone Holding S.p.A., Florence (IT)

( * ) Notice: Subject to any disclaimer, the term of this patent is extended or adjusted under 35 U.S.C. 154(b) by 0 days.

(21) Appl. No.: 09/578,851

(22) Filed: May 26, 2000

(30) Foreign Application Priority Data

May 31, 1999 (IT) ..... MI99A1210

(51) Int. Cl.[7] ..... F01D 5/32
(52) U.S. Cl. ..... 416/221; 416/193 A; 416/220 R
(58) Field of Search ..... 416/220 R, 221, 416/190, 193 A

(56) References Cited

U.S. PATENT DOCUMENTS

| | | | | | |
|---|---|---|---|---|---|
| 2,847,187 | A | * | 8/1958 | Murphy | 416/221 |
| 3,045,329 | A | * | 7/1962 | Carli et al. | 416/221 |
| 3,748,060 | A | * | 7/1973 | Hugoson et al. | 416/92 |
| 4,344,738 | A | * | 8/1982 | Kelly et al. | 416/95 |
| 4,478,554 | A | * | 10/1984 | Surdi | 416/220 R |
| 5,584,659 | A | * | 12/1996 | Schmidt | 416/221 |

FOREIGN PATENT DOCUMENTS

| | | | | | |
|---|---|---|---|---|---|
| DE | 1032753 | A | * | 6/1958 | 416/221 |
| FR | 1068598 | A | * | 6/1954 | 416/220 R |
| FR | 2344710 | A | * | 10/1977 | 416/221 |
| GB | 620877 | A | * | 3/1949 | 416/221 |
| GB | 881690 | A | * | 11/1961 | 416/221 |
| GB | 948722 | A | * | 2/1964 | 416/221 |

* cited by examiner

*Primary Examiner*—Christopher Verdier
(74) *Attorney, Agent, or Firm*—Nixon & Vanderhye

(57) ABSTRACT

A device for securing blades of the first stage of a gas turbine wherein the blades having cooling passages for flowing cooling air from the blade roots towards the blade airfoils. A plurality of plates, each of which has at least one U-shaped projection, engages a corresponding U-shaped groove in the surface of a rotor disc of the first stage. Each plate is interposed between two adjacent first stage blades to secure the blades axially. Second stage turbine blades are secured against axial movement by a plurality of plates, each of which is interposed between the end portion of the foot of a corresponding blade and the turbine disc. Each of the latter plates is provided with ends to secure the blade axially.

9 Claims, 3 Drawing Sheets

SECURING DEVICES FOR BLADES FOR GAS TURBINES

The present invention relates to a securing device for blades for gas turbines.

In particular, the present invention relates to a securing device for cooled blades for gas turbines, of the type used in the first stages of the turbine, which are the hottest stages, and a securing device for non-cooled blades, such as those used for subsequent stages of the turbines, which are the coldest stages.

The present invention also relates to plates for securing first- and second-stage blades for gas turbines.

As is known, gas turbines are machines which consist of a compressor and of a turbine with one or more stages, wherein these components are connected to one another by a rotary shaft, and wherein a combustion chamber is provided between the compressor and the turbine.

Subsequently, via corresponding ducts, the high-temperature, high-pressure gas reaches the various stages of the turbine, which transforms the enthalpy of the gas into mechanical energy which is available to a user.

In two-stage turbines, the gas is processed in the first stage of the turbine in temperature and pressure conditions which are quite high, and undergoes initial expansion in it; whereas in the second stage of the turbine it undergoes a second expansion, in temperature and pressure conditions which are lower than in the previous case.

It is also known that in order to obtain the maximum output from a specific gas turbine, the temperature of the gas needs to be as high as possible; however, the maximum temperature values which can be obtained in use of the turbine are limited by the resistance of the materials used.

Thus, owing to the high temperatures to which they are subjected, the blades which are used in the first stage of the turbines must be cooled, and for this purpose they have a surface which is suitably provided with holes for cooling of the outer surface of the ducts which permit circulation of air inside the blade itself.

In addition, in the root or foot of the blade, there are generally provided one or more ducts in order to permit supply and circulation of cooling air obtained from the compressor.

Unlike in the case of the first-stage blades, since the second-stage blades operate with gas at lower temperatures, in general they do not have these aeration ducts in their foot.

However, in both cases, a problem which occurs particularly according to the known art is that of guaranteeing optimum securing of the blades to the rotor disc, in all operating conditions of the machine.

In fact, it is known that the system for securing the blades to the rotor disc represents a crucial aspect of the design of any rotor, taking into account the fact that the latter must withstand loads which are generated by the blades, without giving rise to breakages or other similar disadvantages.

In fact, during operation of the machine, it is known that the rotor blades are subjected to high levels of stress, both radially, and to a lesser extent, axially.

The radial stresses are caused by the high speed of rotation of the turbine, whereas the axial stresses are caused by the effect produced by the flow of gas on the profiled surfaces of the blades.

The same flow of gas transmits to the blades the circumferential component of the stress, which makes it possible to gather useful power at the motor shaft.

However, the system for securing the blades must have the smallest possible dimensions, such as to reduce to the smallest possible dimensions the assembly constituted by the rotor disc and the blades.

The object of the present invention is thus to provide a securing device for blades for gas turbines, which has a low cost, and consists of a reduced number of component parts.

The device according to the invention thus has a structure which is extremely simple and compact.

Another object of the invention consists of providing a securing device for blades for gas turbines, which permits inflow of the air necessary in order to cool the blades of the first stage of the gas turbine, without creating problems of losses of load.

Another object of the invention is to provide a securing device for blades for gas turbines which permits easy assembly and dismantling of the blades of the various stages of the turbine, as required.

Another object of the invention is to provide a securing device for blades for gas turbines which has a high level of reliability.

A further object of the invention is to provide a securing device for blades for gas turbines which permits optimum resistance to the axial stresses which act on the blades.

These and other objects are achieved by a securing device for blades for gas turbines, of the type used for the first stage of the turbine, characterised in that it comprises a plurality of plates, each of which is provided with at least one U-shaped projection, which can engage with a corresponding U-shaped groove present in the surface of the disc of the first stage of the turbine, such that each of the said plates is interposed between two adjacent blades in order to secure the latter axially, but nevertheless permits passage of the supply of cooling air.

According to a preferred embodiment of the present invention, each of the U-shaped grooves present in the surface of the disc of the first-stage of the turbine is located at an outer portion of the disc, contained between two adjacent blades.

According to another preferred embodiment of the present invention, each of the securing plates has its own U-shaped projection at its own central part, whereas, when it is in the securing position, it has a pair of ends, both of which are folded at 90° relative to their own longitudinal axis.

According to a further preferred embodiment of the present invention, the securing device for blades for gas turbines, of the type used for the second stage of the turbine, comprises a plurality of plates, each of which is interposed between the end portion of the foot of a corresponding blade and the disc of the second stage of the gas turbine, and each of which is provided with ends in order to secure the said blade axially.

According to a further preferred embodiment of the present invention, when seen in cross-section, the securing plates have a curved profile, with the concave part facing the cavity of the disc.

According to a further preferred embodiment of the present invention, when seen in cross-section, the plates have a plurality of cambers, provided at several points along their own longitudinal development.

Further characteristics of the invention are defined in the claims attached to the present patent application.

Further objects and advantages of the present invention will become apparent from examination of the following description and the attached drawings, which are provided purely by way of non-limiting, explanatory example, and in which.

Figure 1:
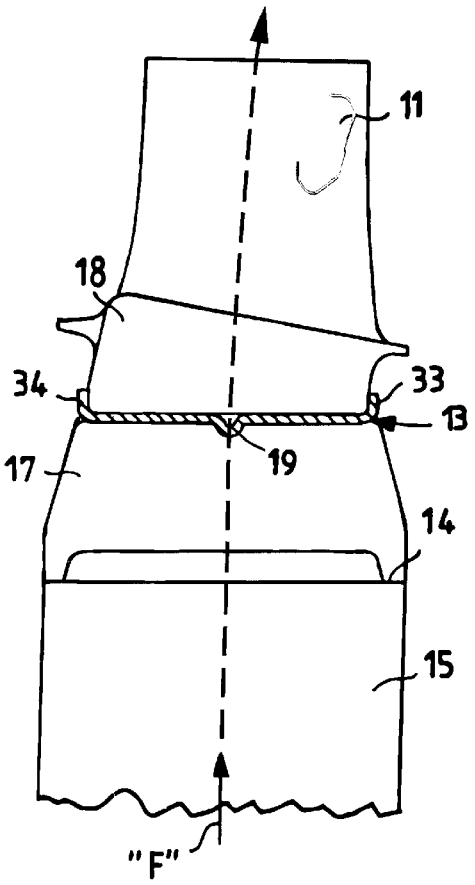
FIG. 1 shows a view, partially in cross-section, of a blade for the first stage of a gas turbine, to which there is fitted the securing device according to a first embodiment of the present invention.
Figure 2:
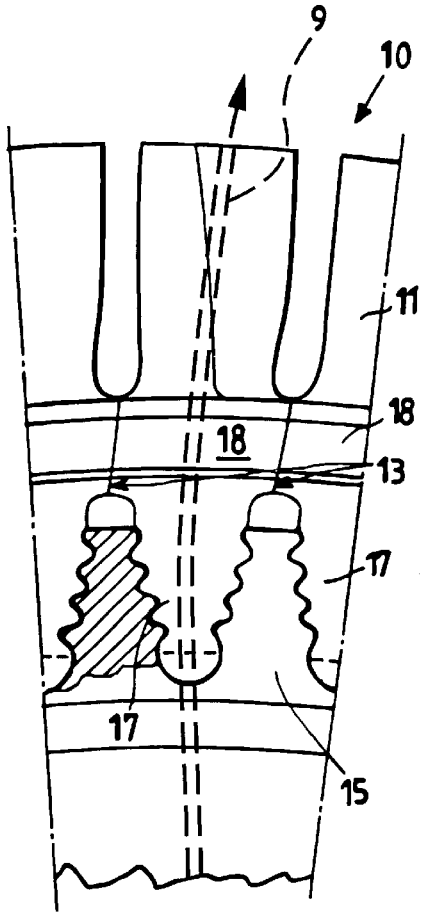
FIG. 2 shows a front view, partially in cross-section, of the first-stage disc of a gas turbine, to which there is fitted the securing device of the embodiment in FIG. 1.
Figure 3:
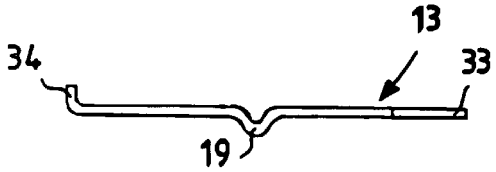
FIG. 3 shows a lateral view of a plate used in the securing device in the embodiment in FIG. 1.

With particular reference to FIGS. 1–4, the securing device for gas turbine blades according to a first embodiment of the present invention is indicated as a whole by the reference number 10.

As is known, in gas turbines, the rotor blades 11 are not integral with the disc 15 of the rotor, but are held in corresponding seats on the circumference of the disc 15.

The seats have sides with a grooved profile, in which the end portion 17 of the foot 18 of the corresponding blade 11 engages.

In conventional embodiments, these seats extend in a direction which is substantially parallel to an axis of the disc 15 of the rotor. In other embodiments on the other hand, the seats extend substantially in a direction which is inclined relative to the axis of the disc 15 itself of the rotor.

In addition, owing to the high temperatures to which they are subjected, these blades 11 have a surface which is suitably provided with holes for ducts 9, which permit circulation of air inside the blade itself.

At their foot 17, the blades 11 also have one or more ducts in order to permit supply and circulation of cooling air obtained from the compressor.

The securing device 10 according to the first embodiment of the present invention takes into account these structural features of the blades 11 of the first stage of the turbines, and comprises a plurality of plates 13, each of which is provided with a U-shaped projection, indicated by the reference number 19, and a pair of ends 33 and 34.

Figure 4:
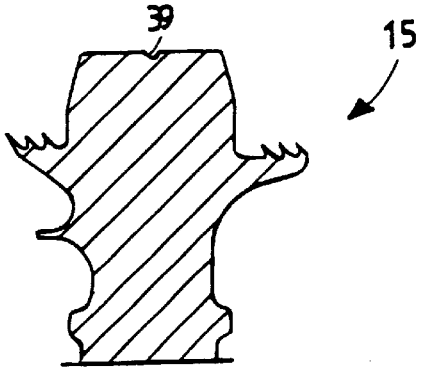
FIG. 4 shows a view in cross-section of a portion of the first-stage disc of a gas turbine, used in the securing device in the embodiment in FIG. 1.
Figure 5:
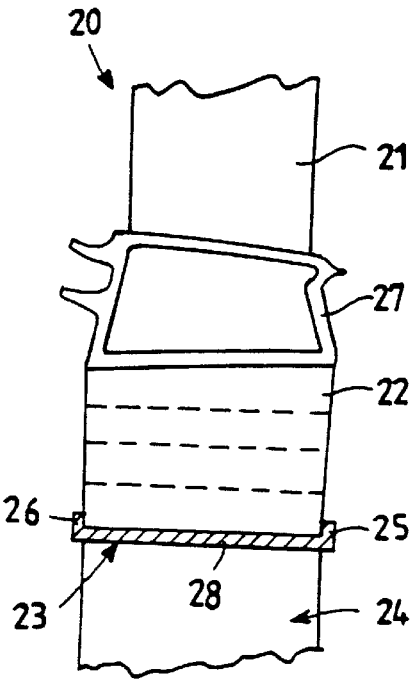
FIG. 5 shows a view, partially in cross-section, of a blade for the second stage of a gas turbine, to which there is fitted the securing device according to an alternative embodiment of the present invention.
Figure 6:
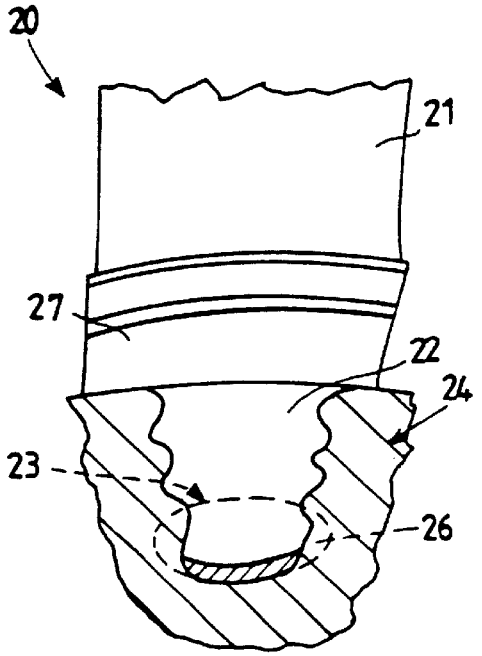
FIG. 6 shows a front view, partially in cross-section, of the second-stage disc of a gas turbine, to which there is fitted the securing device according to an alternative embodiment of the present invention.
Figure 7:
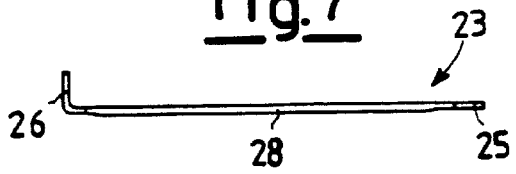
FIG. 7 shows a lateral view of a plate used in the securing device in the embodiment in FIGS. 5–6.
Figure 8:
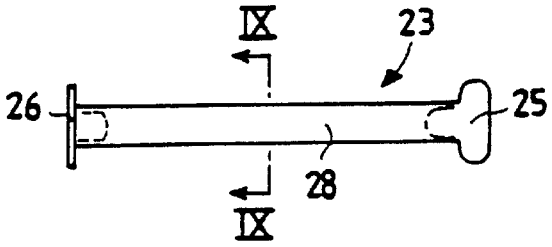
FIG. 8 shows a plan view of the plate used in the securing device in the embodiment in FIGS. 5–6.
Figure 9:
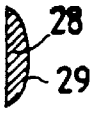
FIG. 9 shows a view according to the cross-section IX—IX in FIG. 8, of the plate used in the securing device in the embodiments in FIGS. 5–6.

Correspondingly, in the surface of the disc 15 of the first stage of the turbine, there are present U-shaped grooves, one of which is indicated by the reference number 39 in FIG. 4.

In particular, each of the U-shaped grooves 39 is located at an outer portion of the disc 15, which is contained between two blades 11 which are adjacent to one another.

The U-shaped projection 19, which belongs to the plate 13, can engage with one of the corresponding U-shaped grooves 39 present in the surface of the first-stage disc 15, such that the blade 13 is interposed between two adjacent blades 11, in order to lock them axially.

This particular position of the plates 13 makes it possible to leave free the passage for the supply of cooling air to the blades 11, which is obtained from the compressor and conveyed into the blade 11, according to the direction of the arrow F in FIG. 1.

More particularly, in order to carry out securing of the blades 11, there is insertion of the securing plate 13, which is folded by means of its own U-shaped projection 19, such that it engages with the U-shaped groove 39 in the first-stage disc 15.

Subsequently, each blade 11 is slid axially along the broaching of the disc 15, which defines the grooved seat for the foot of the blade 11. By this means, the blades 11 are inserted and secured onto the disc 15, whether the seats extend in a direction which is parallel to the axis of the disc 15 of the rotor, or whether the seats extend in a direction which is inclined relative to the axis of the disc 15 itself.

The plate 13 has large surfaces of contact with the disc 15, and with two adjacent blades between which it is interposed, thus guaranteeing reliable, secure locking.

The plate 13 has a first end 34 which is folded at 90°, and after the securing plate 13 has been inserted in position, the second end 33 of the plate 13 is also folded at 90°, so that two adjacent blades 11 are locked axially by this means.

This arrangement makes it possible to avoid obstructing the lower part of the foot, which is used for the supply of the cooling air.

In fact, it will be noted that sealing between the end portion 17 of the foot 18 of the blade 11 and the disc 15 is provided by means of the surfaces 14, whereas the lower intake for the cooling air for the blade 11 is left free.

Finally, it will be noted that the securing system described is extremely simple and economical.

With particular reference to FIGS. 5–12, the securing device for blades for gas turbines according to a further embodiment of the present invention is indicated as a whole by the reference number 20.

This device is designed to be used for securing of the blades of the second stage of the turbine.

In general, the blades 23 of the second stage of the turbine do not need to be cooled to the extent that they require a supply of air from below, and thus, the securing device used in this case has some differences in comparison with the preceding embodiment.

In particular, the device 20 comprises a plurality of plates 23, each of which is interposed between the end portion 22 of the foot 27 of a corresponding second-stage blade 21, and the disc 24 of the second stage of the gas turbine.

Each of the plates 23 is inserted inside the cavity or grooved seat in the disc 24, in which the corresponding blade 21 is inserted, and it is provided with two opposite ends, which are indicated respectively by the reference numbers 25 and 26, and are used to retain the blade 21 axially.

It will be appreciated that each of the ends 25 and 26 of the plates 23 has dimensions which are larger than the cavity in the disc 24, inside which the corresponding blade 21 is inserted.

The securing plates 23 have a shape which is specifically designed for this application, wherein, in particular, there can be seen a longitudinal section 28, which has an end 26 which is folded by 90°, before the blade 21 is fitted.

It can also be seen that the ends 25 and 26 of the plates 23 have a lobed surface shape.

When seen in cross-section, the plates 23 have a curved profile, with the concave part 29 facing the cavity of the disc 24.

Figure 10:
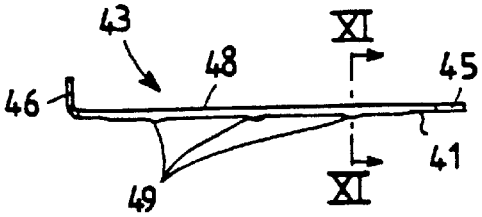
FIG. 10 shows a lateral view of a variant of the plate used in the securing device in the embodiment in FIGS. 5–6.
Figure 11:
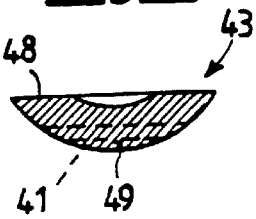
FIG. 11 shows a view along section XI—XI in FIG. 10, of the variant of the plate used in the securing device shown in FIG. 10.
Figure 12:
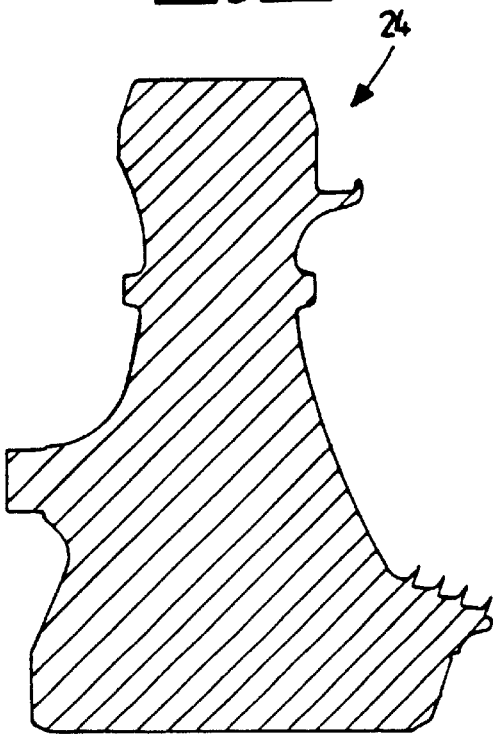
FIG. 12 shows a view in cross-section of a portion of the second-stage disc of a gas turbine used in the securing device in the embodiment in FIGS. 5–6.

According to a variant embodiment, when seen in cross-section, the plates 43 have a plurality of cambers 49, which are produced at several points along their own longitudinal development 48; in the example in FIG. 10 three cambers 49 are present.

In this case also, the ends 45 and 46 of the securing plates 43 have a lobed surface shape and a curved profile, with the concave part 41 facing the cavity of the disc 24.

In the case of the second-stage blades of the turbine, the blade is not cooled, such that the end portion 22 of the foot 27 can be used in order to lock the blade axially.

As in the case of the blades for the first stage of the turbine, the blade 21 is slid axially inside the cavity or seat which has sides with a grooved profile, which is formed by carrying out corresponding broaching of the disc 24.

However, the securing blade 23, which has an end 26 which is already folded, is previously inserted in the cavity between the end portion 22 of the foot 27 of the blade 21 and the disc 24 of the gas turbine.

When the other end of the plate 23 is folded, this locks the blade axially, because these end edges 25 and 26 are larger than the cavity between the end portion 22 of the foot 27 of the blade 21 and the disc 24, and have ends which abut the disc 24 itself.

In this case also, the extreme simplicity and the economic viability of the securing system described are apparent.

The description provided makes apparent the characteristics and advantages of the securing device for blades for gas turbines which is the subject of the present invention.

In particular, the advantages consist firstly of excellent sealing performance, which is obtained without detracting from the flow of air which is necessary in order to cool the blades of the first stage of the gas turbine.

The securing device according to the present invention also makes it possible to avoid undesirable losses of load, whilst being economical to produce, and having a structure which is extremely simple and compact.

Finally, it is apparent that many variants can be made to the securing device for blades for gas turbines which is the subject of the present invention, without departing from the principles of novelty which are inherent in the inventive concept.

Finally, it is apparent that any materials, shapes and dimensions can be used, as required, in the practical embodiment of the invention, and can be replaced by others which are technically equivalent.

What is claimed is:

1. A gas turbine comprising:

a rotor disc having a peripheral surface with a plurality of circumferentially spaced, generally U-shaped grooves;

a plurality of axial entry turbine blades carried by said disc at circumferentially spaced locations thereabout and forming a portion of a first stage of the turbine;

said blades having generally radially extending cooling passages for flowing a cooling medium within the blades;

a plurality of plates each having at least one U-shaped projection for engaging in a corresponding U-shaped groove of said plurality of grooves thereof, each said plate interposed between an adjacent pair of said blades and having locking projections to lock said blades against axial movement relative to said disc whereby the cooling passages are left free for flowing the cooling medium; and a plurality of axial entry blades for a second stage of the gas turbine and carried by a rotor disc of the second stage about a peripheral surface thereof, a plurality of plates for locking said blades of said second stage against axial movement, each of said second-stage locking plates being interposed between an end portion of a foot of a corresponding second stage blade and said second-stage rotor disc and provided with ends for retaining said second stage blades against axial movement.

2. A gas turbine according to claim 1 wherein each of the U-shaped grooves in the disc of said first stage of the turbine is located along an outer portion of the disc between a pair of adjacent blades.

3. A gas turbine according to claim 1 wherein each of said U-shaped projections along each of said plates lies along a central portion of the length of each said plate.

4. A gas turbine according to claim 3 wherein each of said securing plates has opposite ends projecting generally 90° relative to an axis of the plate.

5. A gas turbine according to claim 1 wherein said second-stage rotor disc has a plurality of cavities thereabout for receiving portions of said second stage blades, said ends having dimensions larger than the cavity of the disc into which the corresponding foot of a second stage blade is received to lock said blades against axial movement.

6. A gas turbine according to claim 5 wherein said ends of said second-stage plates have lobed surfaces.

7. A gas turbine according to claim 1 wherein said plates for said second stage have a curved profile extending in a generally axial direction and have an axially extending concave surface facing outwardly toward the cavity of the second-stage rotor disc.

8. A gas turbine according to claim 1 wherein each of the second-stage plates has a plurality of cambers at spaced locations along the longitudinal extent of said second-stage plates.

9. A gas turbine according to claim 1 wherein said second-stage rotor disc has a plurality of cavities thereabout for receiving portions of said second stage blades, said plate ends having dimensions larger than the cavity of the disc into which the corresponding foot of a blade is received to lock said blades against axial movement, said plates for said second stage having a curved profile extending in a generally axial direction and having an axially extending concave surface facing outwardly toward the cavity of the second-stage rotor disc, each of the second-stage plates having a plurality of cambers at spaced locations along the longitudinal extent of said second-stage plates.

* * * * *